US010400542B2

(12) United States Patent
Hazel et al.

(10) Patent No.: US 10,400,542 B2
(45) Date of Patent: Sep. 3, 2019

(54) DOWNHOLE COMPLETION SYSTEM

(71) Applicant: Welltec Oilfield Solutions AG, Zug (CH)

(72) Inventors: Paul Hazel, Aberdeen (GB); Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 116 days.

(21) Appl. No.: 15/309,858

(22) PCT Filed: May 8, 2015

(86) PCT No.: PCT/EP2015/060225

§ 371 (c)(1),
(2) Date: Nov. 9, 2016

(87) PCT Pub. No.: WO2015/169959

PCT Pub. Date: Nov. 12, 2015

(65) Prior Publication Data

US 2017/0145779 A1 May 25, 2017

(30) Foreign Application Priority Data

May 9, 2014 (EP) ..... 14167760
Nov. 10, 2014 (EP) ..... 14192566

(51) Int. Cl.
*E21B 33/124* (2006.01)
*E21B 33/127* (2006.01)
(Continued)

(52) U.S. Cl.
CPC ..... *E21B 33/1243* (2013.01); *E21B 33/127* (2013.01); *E21B 47/06* (2013.01); *E21B 47/124* (2013.01); *E21B 47/14* (2013.01)

(58) Field of Classification Search
CPC .... E21B 33/127; E21B 33/1243; E21B 47/06; E21B 47/124; E21B 47/14
See application file for complete search history.

(56) References Cited

U.S. PATENT DOCUMENTS 5,706,892 A 1/1998 Aeschbacher, Jr. et al.
6,223,821 B1 5/2001 Coronado
(Continued)

FOREIGN PATENT DOCUMENTS

CN 203239329 U 10/2013
RU 2 128 279 C1 3/1999
(Continued)

OTHER PUBLICATIONS

International Search Report and Written Opinion of the ISA for PCT/EP2015/060225, dated Dec. 2, 2015, 13 pages.
(Continued)

*Primary Examiner* — Yong-Suk Ro
(74) *Attorney, Agent, or Firm* — Nixon & Vanderhye P.C.

(57) ABSTRACT

A downhole completion system includes a production casing installed in a borehole and an annular barrier system to be expanded in an annulus between a production casing and a wall of a borehole or another well tubular structure downhole for providing zone isolation between a first and second zones. An annular barrier has a tubular metal part adapted to be mounted as part of the production casing. The downhole completion system further includes a sensor device which is in communication with the first zone and/or second zone, respectively, the sensor device being adapted to measure the first pressure of the first zone and the second pressure of the second zone for verifying the zone isolation.

25 Claims, 14 Drawing Sheets

(51) Int. Cl.

| | |
|---|---|
| ***E21B 47/06*** | (2012.01) |
| ***E21B 47/12*** | (2012.01) |
| ***E21B 47/14*** | (2006.01) |

(56) References Cited

U.S. PATENT DOCUMENTS

| | | | |
|---|---|---|---|
| 6,427,530 | B1 | 8/2002 | Krueger et al. |
| 2001/0050170 | A1 | 12/2001 | Woie et al. |
| 2003/0213591 | A1 | 11/2003 | Kuchuk et al. |

FOREIGN PATENT DOCUMENTS

| | | | |
|---|---|---|---|
| SU | 1113514 | A | 9/1984 |
| WO | WO 2013/079574 | A1 | 6/2013 |
| WO | WO 2013/092801 | A1 | 6/2013 |

OTHER PUBLICATIONS

Extended Search Report for EP 14167760, dated Oct. 31, 2014, 8 pages.

Office Action of Substantive Examination dated Dec. 17, 2018 in Russian Application No. 2016145849/03(073631), with English Translation (13 pages).

Notification of the Second Office Action dated Feb. 19, 2019 in Chinese Application No. 201580022030.5, with English translation, 7 pages.

DOWNHOLE COMPLETION SYSTEM

This application is the U.S. national phase of International Application No. PCT/EP2015/060225filed 8 May 2015, which designated the U.S. and claims priority to EP Patent Application No. 14167760.9 filed 9 May 2014, and EP Patent Application No. 14192566.9 filed 10 Nov. 2014, the entire contents of each of which are hereby incorporated by reference.

FIELD OF THE INVENTION

The present invention relates to a downhole completion system comprising a production casing installed in a borehole and an annular barrier system to be expanded in an annulus between a production casing and a wall of a borehole or another well tubular structure downhole for providing zone isolation between a first zone having a first pressure and a second zone having a second pressure of the borehole. The present invention also relates to a verification method for verifying zone isolation and to a monitoring method for monitoring a condition of a well.

BACKGROUND ART

When completing a well, production zones are provided by submerging a casing string having annular barriers into a borehole or a casing of the well. When the casing string is in the right position in the borehole or in another casing in the borehole, the annular barriers are expanded, swelled or inflated to isolate a first zone and a second zone between a well tubular structure and the borehole or an inner and an outer tubular structure. In some completions, the annular barriers are expanded by pressurised fluid, which requires a certain amount of additional energy. In other completions, a compound inside the annular barrier is heated so that the compound becomes gaseous, hence increasing its volume and thus expanding the expandable metal sleeve.

However, since it may be difficult to control if the expansion of the annular barrier has been performed correctly, uncertainty may arise regarding the isolation and sealing properties of the annular barrier between the first and second zones if the well does not function as planned after completion.

Two annular barriers are thus used to isolate a production zone, and testing the pressure and temperature through the production opening in the production casing in between the two annular barriers may be easily performed by means of a testing tool, known from US 2003/213591. However, testing of isolation and sealing properties of the annular barriers cannot be tested by such tools.

SUMMARY OF THE INVENTION

It is an object of the present invention to wholly or partly overcome the above disadvantages and drawbacks of the prior art. More specifically, it is an object to provide an improved downhole completion system having annular barriers, the isolation and sealing properties of which can be tested.

The above objects, together with numerous other objects, advantages and features, which will become evident from the below description, are accomplished by a solution in accordance with the present invention by a downhole completion comprising:

a production casing installed in a borehole, and an annular barrier system to be expanded in an annulus between a production casing and a wall of a borehole or another well tubular structure downhole for providing zone isolation between a first zone having a first pressure and a second zone having a second pressure of the borehole, the annular barrier system comprising an annular barrier comprising:

a tubular metal part adapted to be mounted as part of the production casing, the tubular metal part having an outer face, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, the annular space having a space pressure, wherein the downhole completion system further comprises a sensor device which is in communication with the first zone and/or second zone, respectively, the sensor device being adapted to measure the first pressure of the first zone and the second pressure of the second zone for verifying the zone isolation.

By arranging the sensor device in communication with the second zone, which is not the production zone, to measure the second pressure of the second zone, the zone isolation of the annular barrier providing zone isolation between the first zone and the second zone can be verified. When the pressure in the production zone, which is the first zone, changes, the pressure in the second zone should remain unchanged if the annular barrier provides proper isolation and sealing properties. The pressure in the production zone changes while the production casing is pressurised from within during expansion of the annular barriers and while the formation is fractured.

The second zone may be a production zone.

Also, the sensor device may be arranged in the first zone.

Moreover, the sensor device may be adapted to measure the first pressure of the first zone in order to verify the zone isolation.

A production casing may be installed in the well for producing hydrocarbon-containing fluid from a reservoir.

Further, the sensor device may be arranged on the outside of the tubular metal part.

In addition, the sensor device may comprise an acoustic transducer.

Said acoustic transducer may be configured to transmit and/or receive mechanical vibrations.

Furthermore, the sensor device may comprise a piezoelectric element.

The piezoelectric element may be configured to transmit and/or receive mechanical vibrations.

Also, the sensor device may comprise at least a first pressure sensor for measuring the first and the second pressures.

Moreover, the sensor device may comprise a control unit for providing communication between the first pressure sensor and the first zone or the first pressure sensor and the second zone.

Also, the sensor device may be in fluid communication with the first zone and/or the second zone.

Furthermore, the first pressure sensor may be in fluid communication with the first zone and/or the second zone.

In addition, the first pressure sensor may be connected with the first zone by means of a fluid channel.

Further, the fluid channel may be divided by a movable partition such as a piston or a diaphragm.

The control unit may comprise a switch and/or a solenoid.

Moreover, a three-way valve may be arranged in connection with the first pressure sensor, the three-way valve being controlled by the solenoid.

Also, the first pressure sensor may be in communication with the first zone and a second pressure sensor may be in communication with the second zone.

Further, the first pressure sensor may be arranged in the first zone and the second pressure sensor may be arranged in the second zone.

One or both of the ends of the expandable metal sleeve may be connected with the tubular metal part by means of connection parts.

The sensor device may further comprise a shuttle valve having an element which is movable at least between a first position and a second position, the shuttle valve having a first inlet which is in fluid communication with the second zone, and a second inlet which is in fluid communication with the first zone, and the shuttle valve having an outlet which is in fluid communication with the annular space, and in the first position, the first inlet is in fluid communication with the outlet, equalising the second pressure of the second zone with the space pressure, and in the second position, the second inlet is in fluid communication with the outlet, equalising the first pressure of the first zone with the space pressure.

Moreover, the first pressure sensor may be arranged in connection with the second inlet of the shuttle valve, and the second pressure sensor may be arranged in connection with the first inlet of the shuttle valve.

The downhole annular barrier system as described above may further comprise a third pressure sensor in fluid communication with the annular space.

Said third pressure sensor may be arranged in connection with the outlet of the shuttle valve.

Also, the third pressure sensor may be arranged in the annular space.

Furthermore, the third pressure sensor may be arranged in the first zone or the second zone.

The sensor device may comprise a storage module, such as a memory, a recording unit or a CPU.

Further, the sensor device may comprise a communication module.

Said communication module may comprise a transmitter, preferably a wireless transmitter.

Moreover, the communication module may comprise an acoustic transducer,

Said acoustic transducer may comprise a piezoelectric element.

Furthermore, the sensor device may comprise a power supply.

Also, the communication module may comprise an induction unit configured to charge the power supply through the casing.

Additionally, the sensor device may comprise an additional sensor adapted to measure at least one fluid property, the fluid property being e.g. capacitance, resistivity, flow rate, water content or temperature.

The additional sensor may be a flow rate sensor, a capacitance sensor, a resistivity sensor, an acoustic sensor, a temperature sensor or a strain gauge.

Also, the wireless transmission may be performed by means of an antenna, induction, electromagnetic radiation or telemetry.

Furthermore, the expandable sleeve may be made of metal.

In addition, the tubular part may be made of metal.

Further, an opening may be arranged in the tubular metal part.

Sealing means may be arranged between the connection part or end of the expandable metal sleeve and the tubular metal part.

Moreover, the annular space may comprise a second sleeve.

The downhole completion system according to the present invention may further comprise a downhole tool having a tool communication module for reading and/or loading measurements from the annular barrier system.

Also, the downhole completion system as described above may further comprise a pressure source for increasing the first pressure of the first zone or for increasing the second pressure of the second zone.

Furthermore, the first pressure may be increased via a frac port, a sliding sleeve, an inflow valve or port, a porter collar or from the surface.

A plurality of annular barrier systems may be arranged in connection with the well tubular structure.

Further, communication units may be arranged along the well tubular structure.

The present invention also relates to a verification method for verifying zone isolation between a first zone having a first pressure and a second zone having a second pressure of the borehole, the method comprising the steps of:

- expanding an annular barrier system as described above for providing the zone isolation between the first zone having the first pressure and the second zone having the second pressure,
- increasing the first pressure,
- measuring the first increased pressure and the second pressure, and
- performing an isolation check by comparing the increased first pressure with the second pressure.

The verification method as described above may further comprise the step of transmitting the measured pressures to a downhole tool and/or a receiver.

Also, the verification method as described above may comprise the step of recharging a power supply of the annular barrier system by means of a downhole tool.

The present invention also relates to a monitoring method for monitoring a condition of a well, comprising the steps of:

- expanding an annular barrier system as described above for providing zone isolation between a first zone having a first pressure and a second zone having a second pressure,
- measuring the first pressure,
- measuring the second pressure,
- repeating the steps of measuring the first and second pressures, and
- storing and/or transmitting the measured pressures.

The monitoring method as described above may also comprise the step of, while expanding the expandable metal sleeve of the annular barrier, measuring a third pressure inside the annular space by means of a third pressure sensor.

Furthermore, the monitoring method as described above may further comprise the steps of:

- measuring a third pressure inside the annular space,
- comparing the third pressure with the first pressure and/or the second pressure, and
- equalising the third pressure with the first pressure or with the second pressure.

Finally, the monitoring method as described above may comprise the step of recharging a power supply of the annular barrier system by means of a downhole tool.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
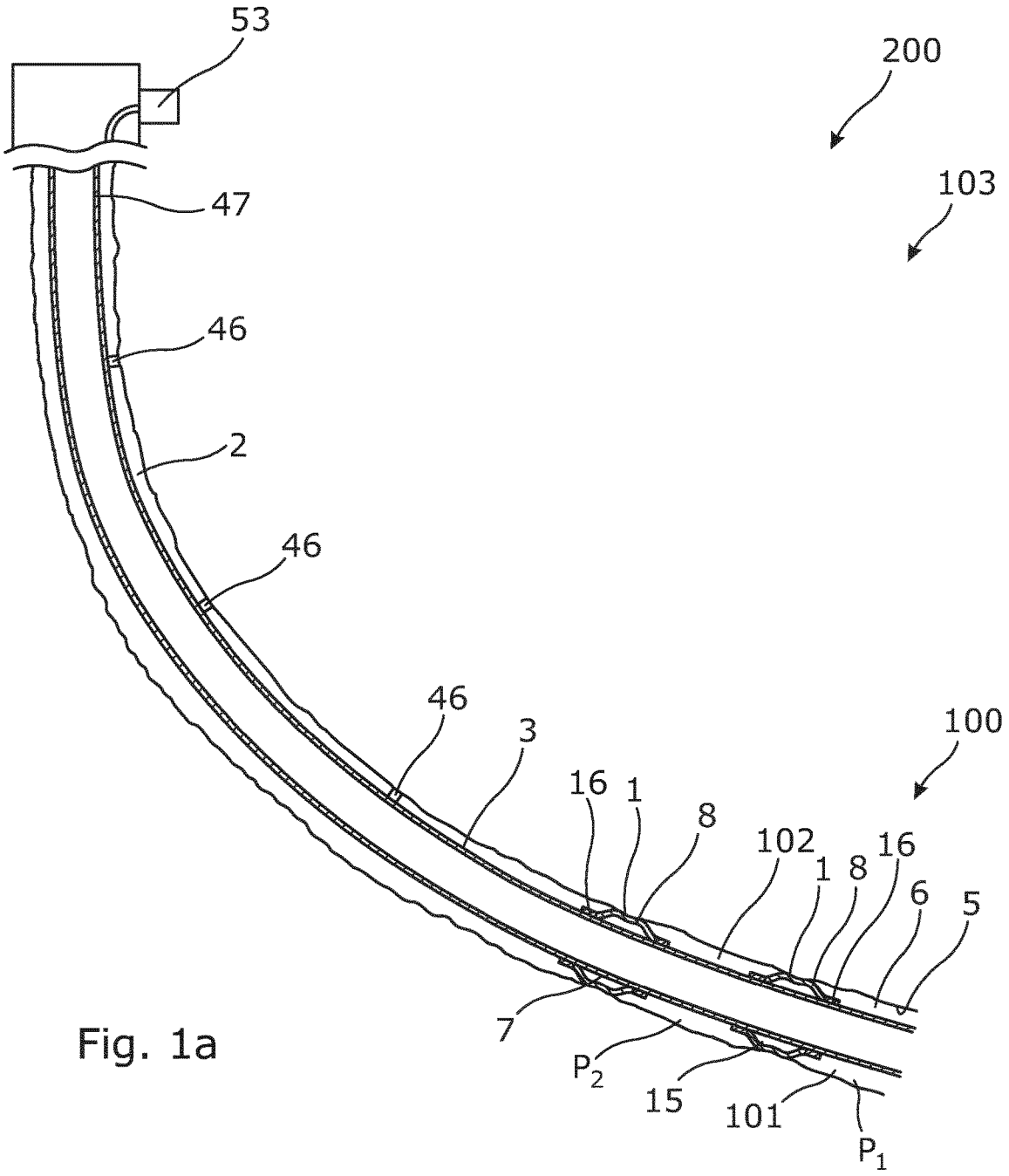
FIG. 1*a* shows a cross-sectional view of a downhole completion system.

FIG. 1*a* shows a downhole completion system 200 comprising a production casing 3 installed permanently in a borehole 6 for producing hydrocarbon-containing fluid from a formation of a well and an annular barrier system 100 comprising two annular barriers 1 expanded in an annulus 2 between the production casing 3 and a wall 5 of the borehole 6 downhole isolating a production zone for producing hydrocarbon-containing fluid from a reservoir. Thus, one of the barriers provides zone isolation between a first zone 101 having a first pressure $P_1$ and a second zone 102, which is the production zone, having a second pressure $P_2$ of the borehole. Each annular barrier system 100 comprises a tubular metal part 7 mounted as part of the production casing 3, an expandable metal sleeve 8 surrounding the tubular metal part 7 connected to an outer face the tubular metal part defining an annular space 15 between the expandable metal sleeve and the tubular metal part. The isolation is provided by expanding the expandable metal sleeve, e.g. by increasing the pressure inside the tubular metal part and letting the pressurised fluid into the annular space. The annular barrier 1 comprises a sensor device 16 which is in communication with the first zone and adapted to measure at least the first pressure of the first zone for verifying the zone isolation. The sensor device 16 is arranged outside of the tubular metal part in the first zone and is in fluid communication with the first zone.

By arranging the sensor device in communication with the first zone, which is not the production zone, to measure the first pressure of the first zone, the zone isolation of the annular barrier providing zone isolation between the production 102 and the first zone 101 can be verified. When the pressure in the production zone 102 changes, the pressure in the first zone should remain unchanged if the annular barrier provides proper isolation and sealing properties. The pressure in the production zone 102 changes while the production casing is pressurised from within during expansion of the annular barriers and while the formation is fractured. After the annular barrier has been expanded and seals against the borehole, the pressure in the production zone 102 will continue to increase until the pressure inside the tubular metal part is decreased, but the pressure in the first zone 101 does not increase and the isolation capability of the annular barrier is thus verified. Subsequently, the isolation capability of the annular barrier can easily be verified by increasing the pressure in the production zone 101 while measuring the pressure in the first zone 101 which should remain constant during the pressurisation of the production zone if the annular barrier functions properly.

Figure 1B:
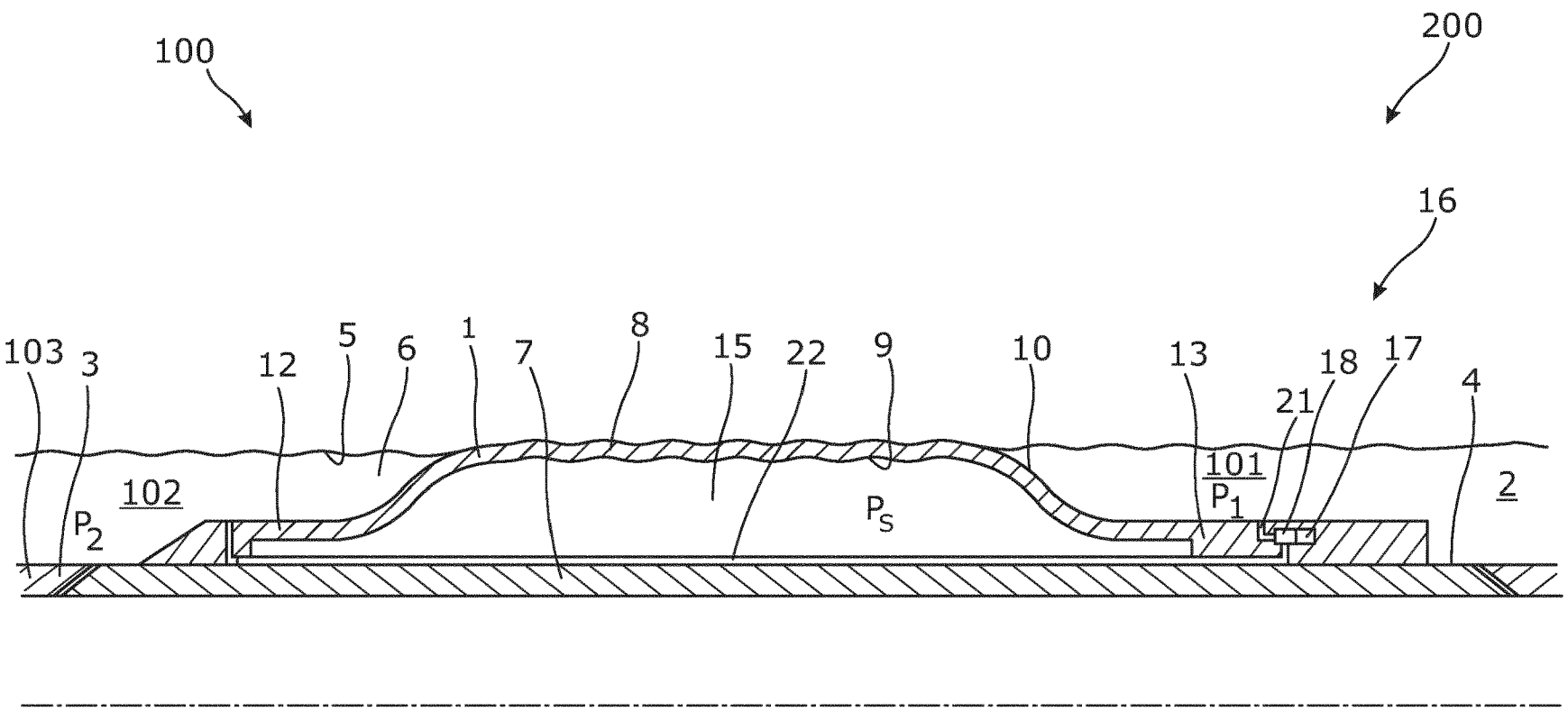
FIG. 1*b* shows a cross-sectional view of an annular barrier system.

FIG. 1*b* shows a downhole annular barrier system 100 comprising an annular barrier 1 to be expanded in an annulus 2 in a hydrocarbon-containing producing well 103 between a production casing 3 and a wall 5 of a borehole 6 or another well tubular structure 3*a* (shown in FIG. 2) downhole for providing zone isolation between a first zone 101 having a first pressure $P_1$ and a second zone 102 having a second pressure $P_2$ of the borehole in order to produce a hydrocarbon-containing fluid from one zone and not from another zone. The first zone is closest to a lower part of the borehole and the second zone is closest to a top of the borehole nearer the surface of the well 103, the second zone being the production zone.

The annular barrier comprises a tubular metal part 7 adapted to be mounted as part of the well tubular structure 3 (shown in FIG. 2) being a casing string or a production casing 3 for producing hydrocarbon-containing fluid, e.g. by means of conventional threaded connections. The tubular metal part 7 has an outer face 4 surrounded by an expandable metal sleeve 8. The expandable metal sleeve has an inner sleeve face 9 facing the tubular metal part and an outer sleeve face 10 facing the wall of the borehole. Each end 12, 13 of the expandable metal sleeve is connected with the tubular metal part enclosing an annular space 15 between the inner sleeve face of the expandable metal sleeve 8 and the tubular metal part 7. The annular space 15 has a space pressure $P_s$ which is increased for expanding the expandable metal sleeve 8 by letting pressurised fluid into the space 15 from within the tubular metal part 7 or by a chemical reaction or decomposing of components present in the annular space 15. The expandable metal sleeve 8 is expanded until it contacts the wall 5 of the borehole 6 or another well tubular structure 3*a* (shown in FIG. 2), and when expanding the sleeve 8, the sleeve divides the annulus in two zones, a first and a second zone 101, 102, respectively.

In order to verify this zone isolation, the annular barrier system 100 further comprises a sensor device 16 which is in communication with a fluid of the first zone 101 and a fluid of the second zone 102, respectively. The sensor device 16 is adapted to measure the first pressure $P_1$ of the first zone 101 and the second pressure $P_2$ of the second zone 102 for verifying the zone isolation. Most often the pressure of the second zone nearest the top is increased to verify that the annular barrier 1 provides sufficient zone isolation. In another situation, the pressure of the first zone 101 is increased instead of the pressure in the second zone 102.

In order to measure the pressure, the sensor device 16 comprises at least a first pressure sensor 17 for measuring the first and the second pressures. In FIG. 1*b*, the sensor device 16 comprises a control unit 18 for providing communication between the first pressure sensor 17 and the first zone 101 or the first pressure sensor and the second zone 102. The control unit 18 switches between a first position in which the first pressure sensor 17 is in communication with the first pressure $P_1$ in the first zone 101 and a second position in which the first pressure sensor 17 is in communication with the second pressure $P_2$ in the second zone 102. Thus, the control unit 18 may comprise a switch or a solenoid for switching between the first position and the second position or even a third position for measuring the space pressure.

In FIG. 1*b*, the sensor device and thus the first pressure sensor is in fluid communication with the first zone and/or the second zone by means of a first fluid channel 21 and a second fluid channel 22. The first fluid channel provides fluid communication with the first zone and/or the second fluid channel provides fluid communication with the second zone. The first fluid channel is arranged in the second end 13 of the expandable metal sleeve and the first fluid channel extends from the second end 13 of the expandable metal sleeve 8, through the annular space and into the first end 12 of the expandable metal sleeve 8. Thus, the sensor device 16 in the first zone 101 has a sensor that communicates wirelessly to a second sensor or communication unit at a second position.

Figure 2:
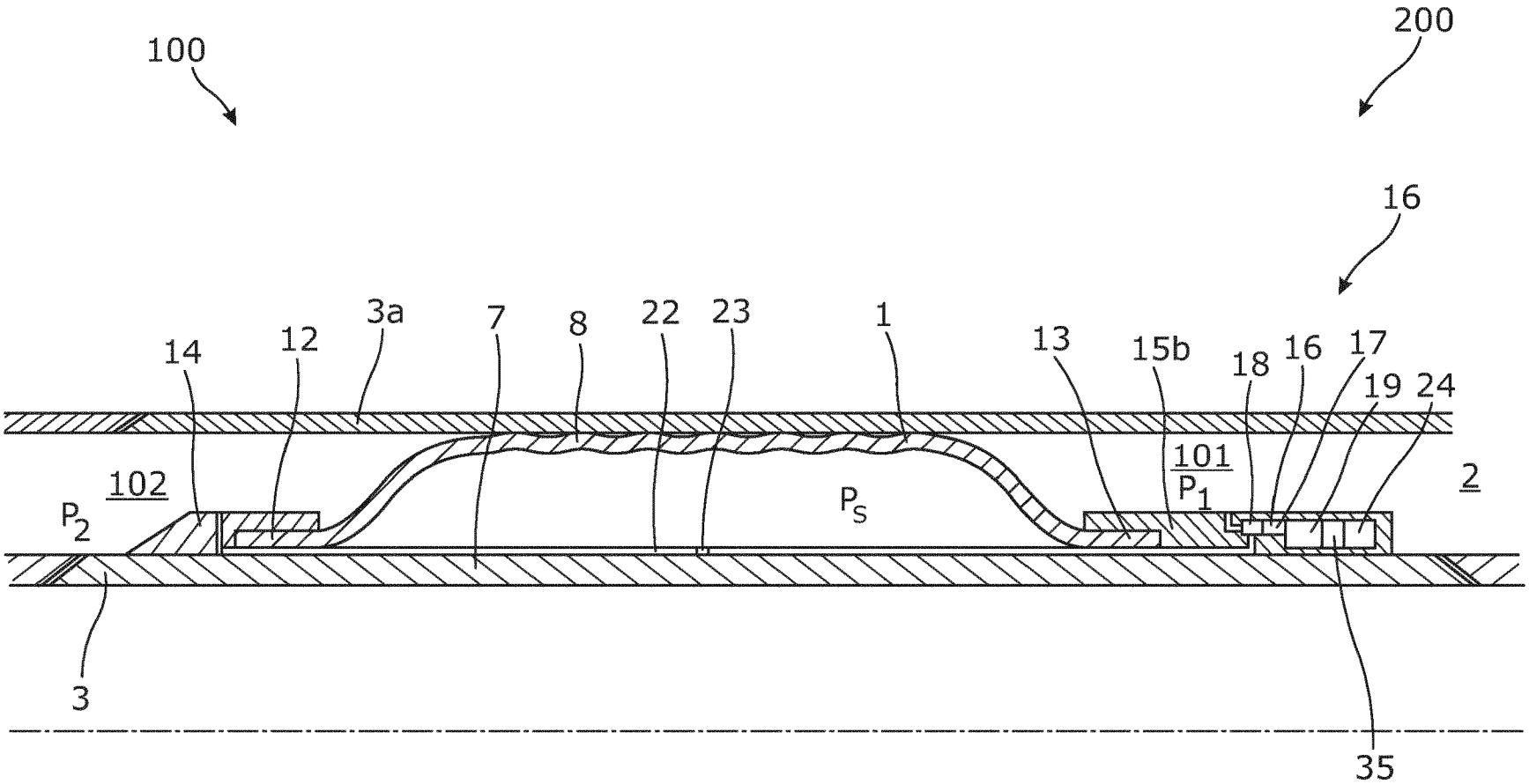
FIG. 2 shows a cross-sectional view of another annular barrier system having a communication module.
Figure 11:
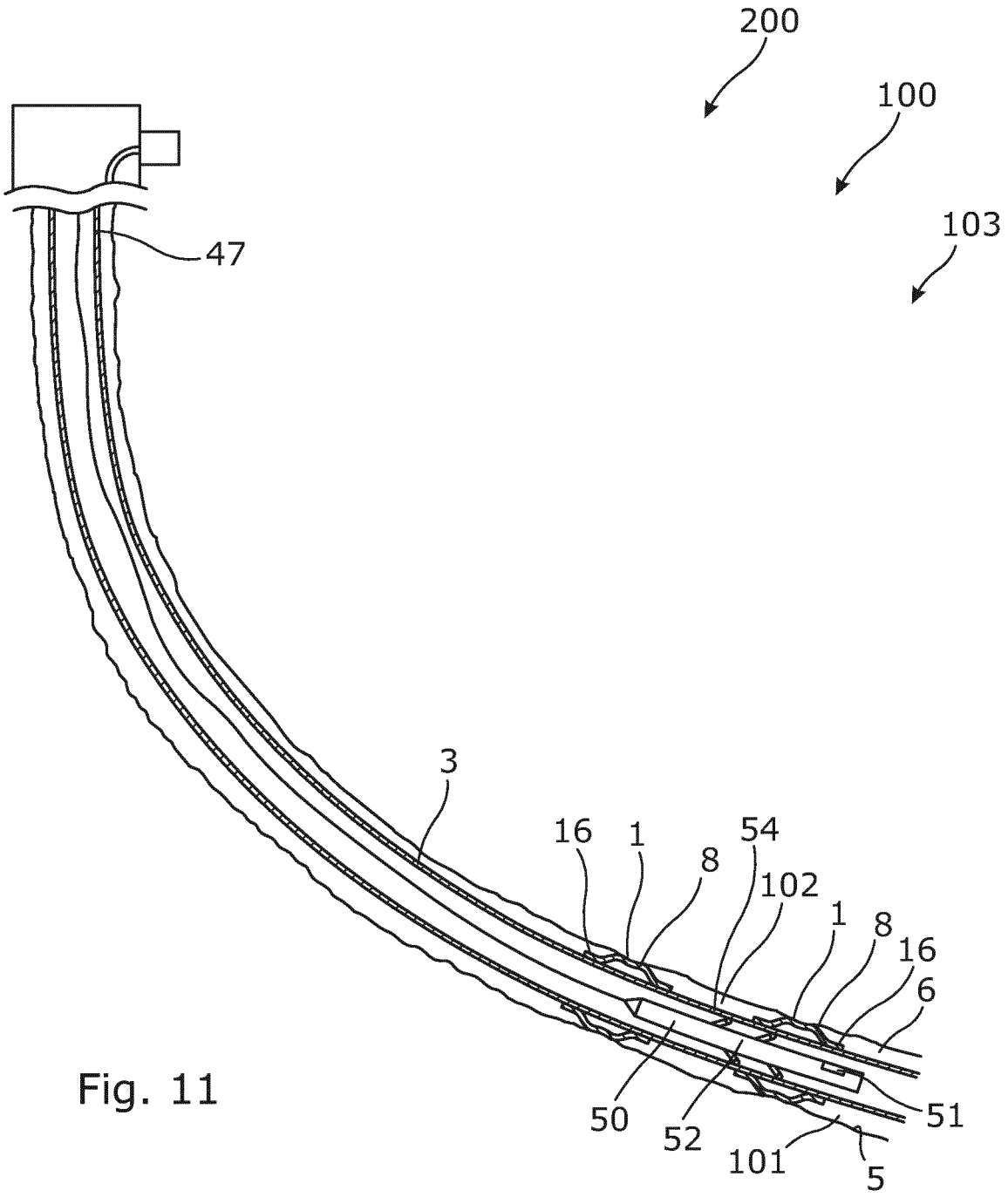
FIG. 11 shows another downhole completion system.

In FIG. 2, the second fluid channel is divided by a movable partition such as a piston or a diaphragm. In this way, the first pressure sensor is not in direct communication with the dirty well fluid, and even though not shown the first channel may also be divided by such movable partition 23 such as a piston or a diaphragm. The sensor device 16 comprises a storage module 19, such as a memory or a recording unit or a CPU. Furthermore, the sensor device 16 comprises a communication module 24 for communicating the measured data to a tool, as shown in FIG. 11, in the well tubular structure 3 or to a communication unit 46 further up the well as shown in FIG. 1*a*. The communication module 24 comprises a transmitter, preferably a wireless transmitter, so that wireless transmission may be performed by means of an antenna, induction, electromagnetic radiation, acoustics or telemetry. The sensor device further comprises a power supply 35, which may be a battery, e.g. a rechargeable battery. The sensor device 16 may also be powered temporarily by the tool 50 (shown in FIG. 11) if the sensor device does not have a power supply or just power. Then the tool arrives at the location of the sensor device and the tool provides the sensor device with sufficient power to perform the measurements and load the data onto the tool.

Figure 3:
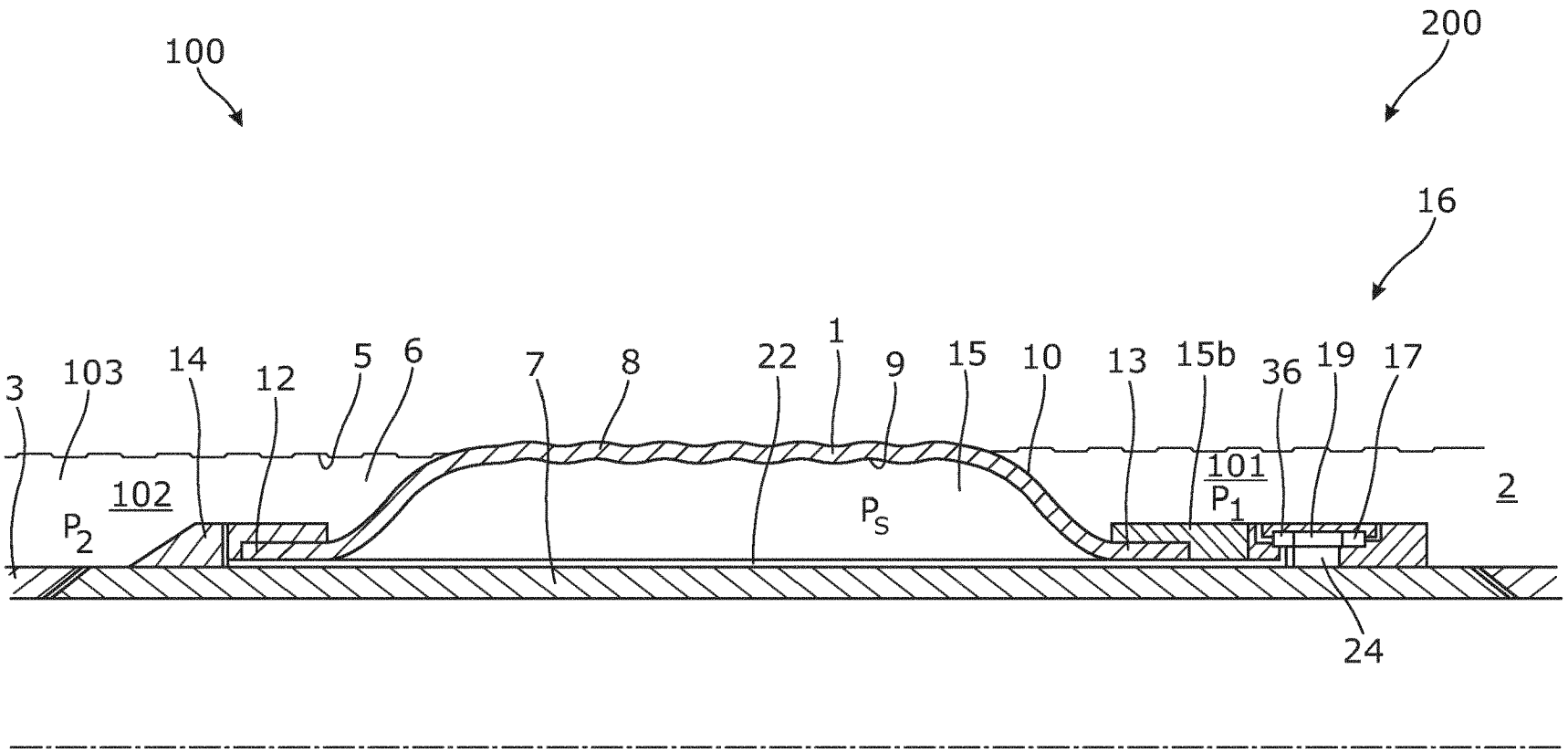
FIG. 3 shows a cross-sectional view of an annular barrier system having two pressure sensors.

In FIG. 3, the first pressure sensor 17 is in communication with the first zone 101 and a second pressure sensor 36 is in communication with the second zone 102. Both the first and the second sensors are arranged in the second end 13 of the sleeve 8. Thus, the first zone has a sensor that communicates wirelessly to the second sensor position.

In FIG. 2, the first end 12 of the expandable metal sleeve 8 is connected with the tubular metal part 7 by means of a first connection part 14, and the second end 13 of the expandable metal sleeve 8 is connected with the tubular metal part 7 by means of a second connection part 15*b*. The second fluid channel 22 extends through the first and the second connection parts 14, 15*b* and the sensor device 16 is arranged in the second connection part 15*b*. In another embodiment, only one of the ends of the expandable metal sleeve 8 is connected with the tubular metal part by means of connection parts.

As shown in FIG. 3, the sensor device 16 may be a separate part connectable as an add-on module to the annular barrier 1. The sensor device 16 is arranged around the tubular metal part 7 and connected with the second fluid channel. The communication module 24 is arranged closest to the outer face of the tubular metal part 7, so that communication through the well tubular structure or production casing is easier and of better quality.

Figure 4:
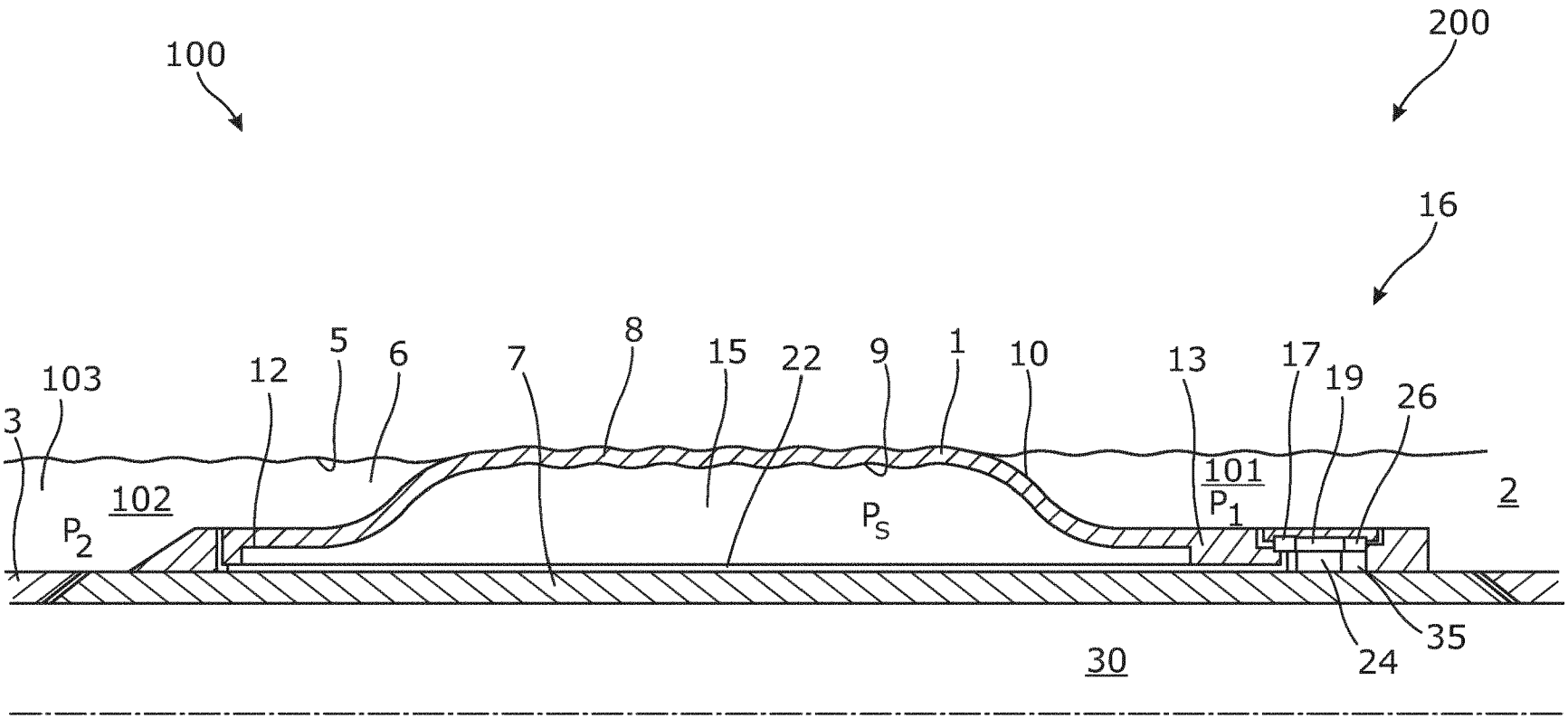
FIG. 4 shows a cross-sectional view of an annular barrier system having a power supply.

In FIG. 4, the sensor device 16 is integrated in the second end 13 of the expandable metal sleeve 8 having an increased thickness, so that during expansion the ends maintain their shape and remains undeformed and thus capable of maintaining the seal between the expandable metal sleeve 8 and the tubular metal part 7.

Figure 5:
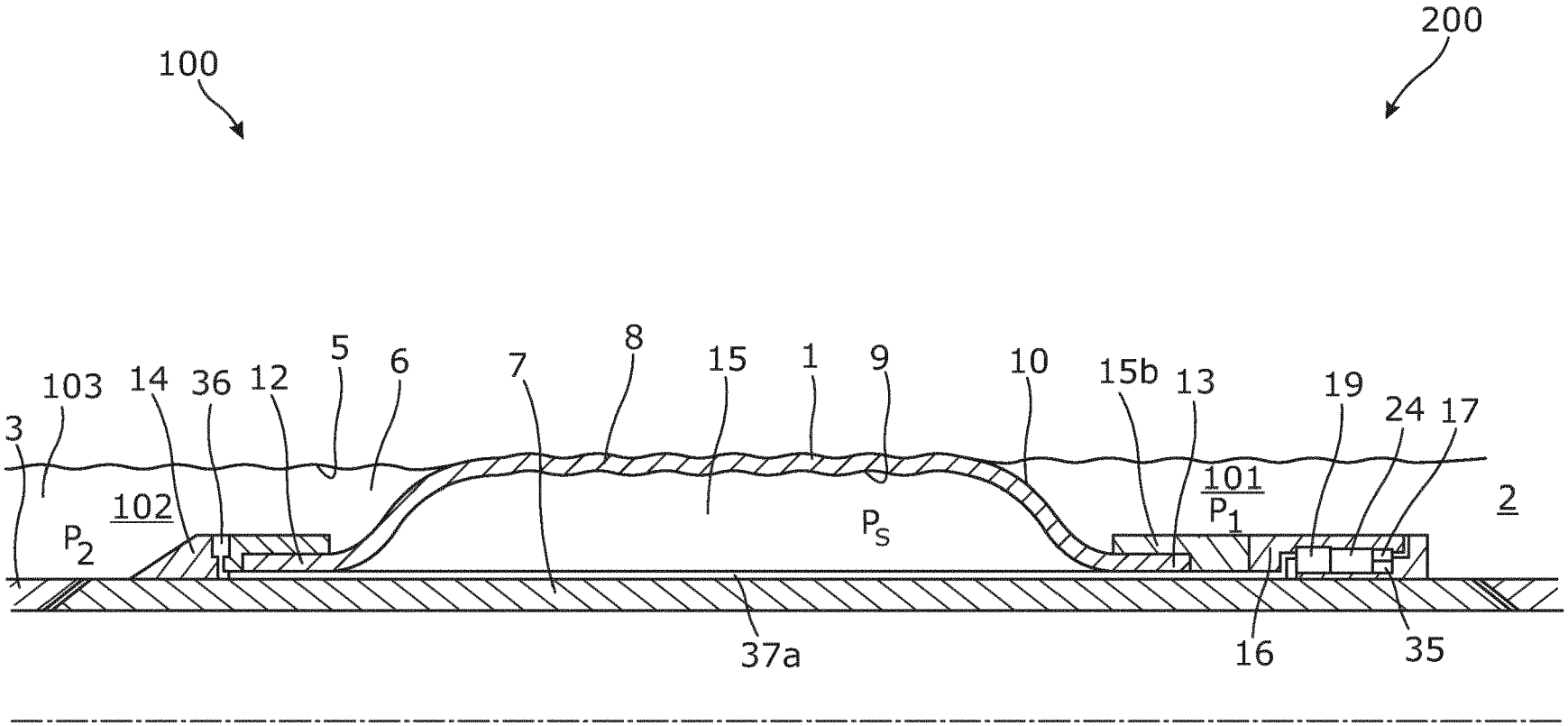
FIG. 5 shows a cross-sectional view of an annular barrier system having two separate pressure sensors.

In FIG. 5, the second pressure sensor 36 is arranged in the first connection part 14 and measured data is recorded in the storage module 19, e.g. a memory, through an electric communication line 37*a* extending through the annular space 15 or in the tubular metal part 7 (not shown). Thus, the first pressure sensor 17 is arranged in the first zone 101 and/or the second pressure sensor 36 is arranged in the second zone 102. The measured data from the sensors 17, 36 may be stored in the storage module 19 and transmitted by the communication module 24 continuously or as data bits at certain intervals, or be emptied into a tool in the well. Thus, the data may be transmitted without being stored and thus the storage device may be dispensed with.

Figure 6:
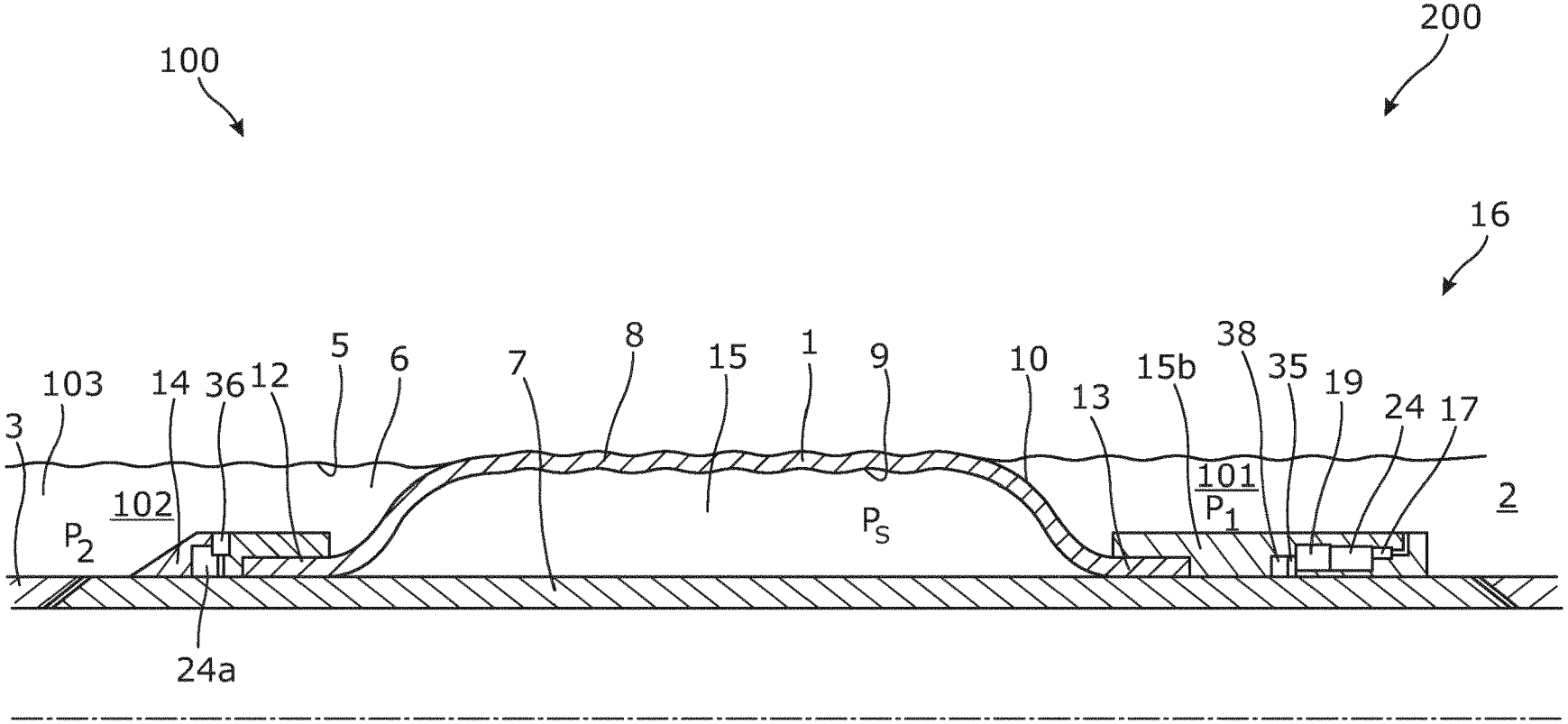
FIG. 6 shows a cross-sectional view of another annular barrier system.

As shown in FIG. 6, a second communication module 24*a* is arranged in connection with the second pressure sensor 36 in order to transmit measured data from the second pressure sensor 36 to the communication module arranged in the second connection part 15*b*. The transmission is thus performed wirelessly and the communication modules may both send and receive data and/or signals of operation. The sensor device 16 further comprises a processor 38 for comparing the data from one sensor with data from another sensor. In this way, only changes in measured data/value are stored in the storage module 19 in order to ensure that the storage capacity is not occupied by irrelevant data. Furthermore, the sensor device 16 comprises a power supply 35 for supplying power to the sensors and the other electronic modules in the sensor device 16. The system 100 could also be programmed to store data based on time, pressure changes or available memory remaining.

Figure 7:
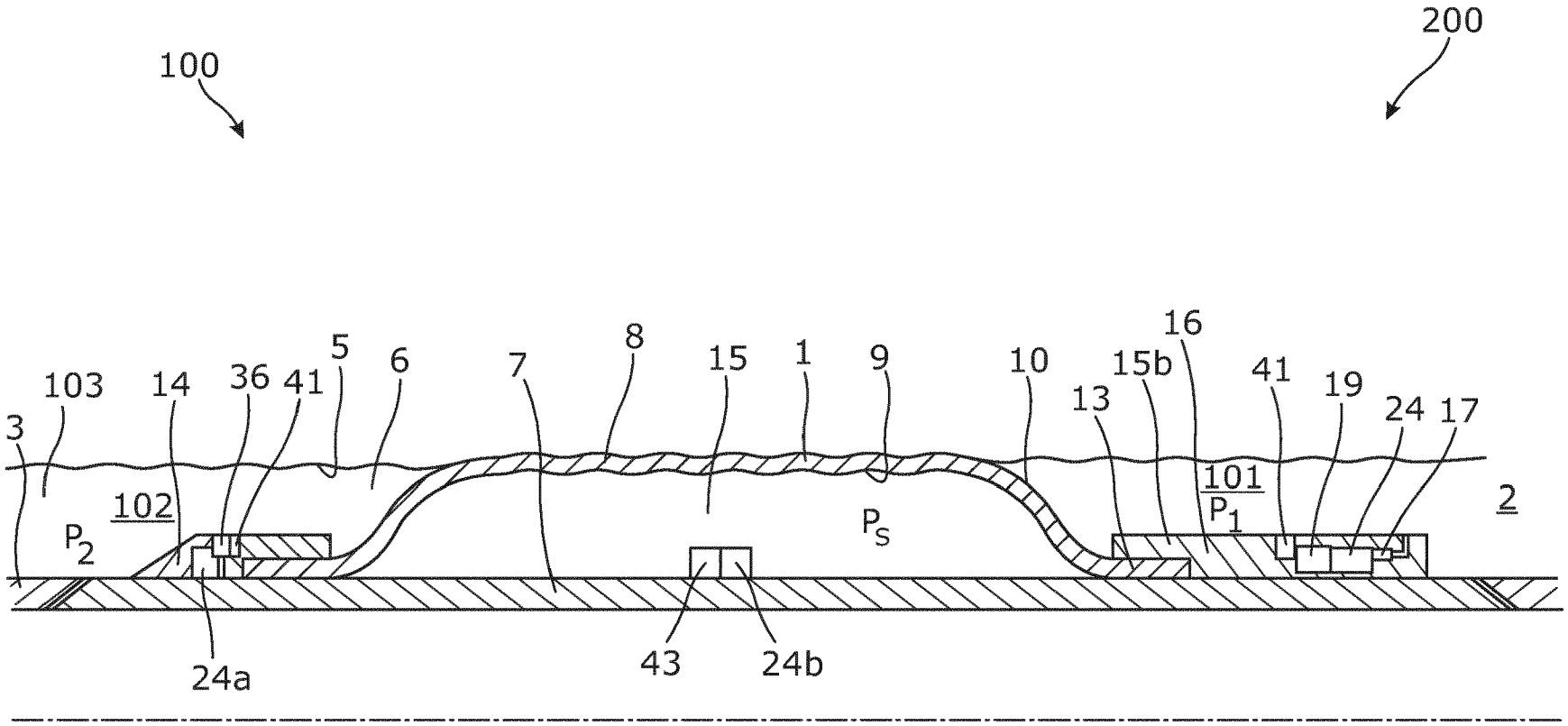
FIG. 7 shows a cross-sectional view of an annular barrier system having a third pressure sensor.

In FIG. 7, the sensor device 16 further comprises additional sensors 41 adapted to measure at least one fluid property, such as capacitance, resistivity, flow rate, water content, temperature or noise (acoustics). The additional sensor may therefore be a flow rate sensor, a capacitance sensor, a resistivity sensor, an acoustic sensor, a temperature sensor or a strain gauge.

The sensor device 16 forms a well data module (WDM) reusing the sensors for monitoring the well 103 after the annular barrier 1 has been expanded and the isolation capability verified. The additional sensors may be used to verify the isolation capability and/or to monitor the well, such as to detect a water break-through in a production zone or just a decreased pressure in the production zone, i.e. in the first or second zone.

Figure 8A:
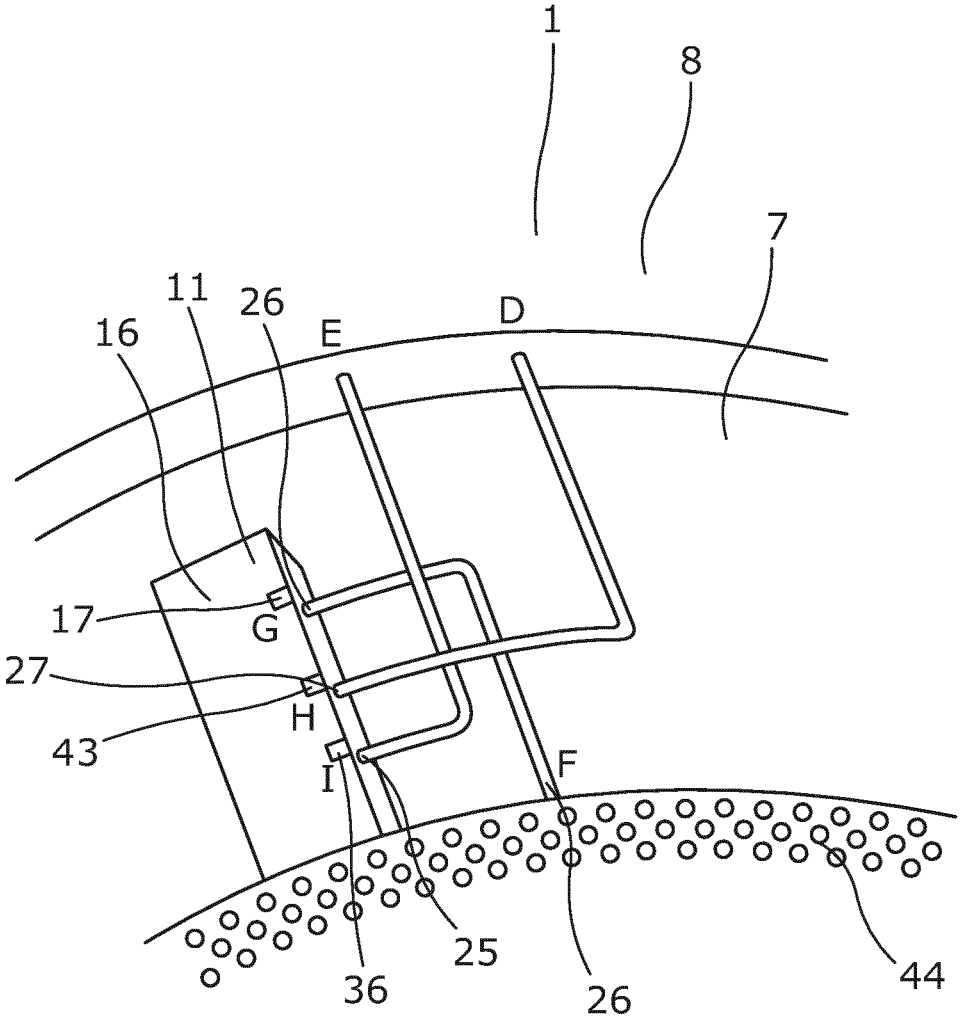
FIG. 8*a* shows a perspective view of an annular barrier system.
Figure 10:
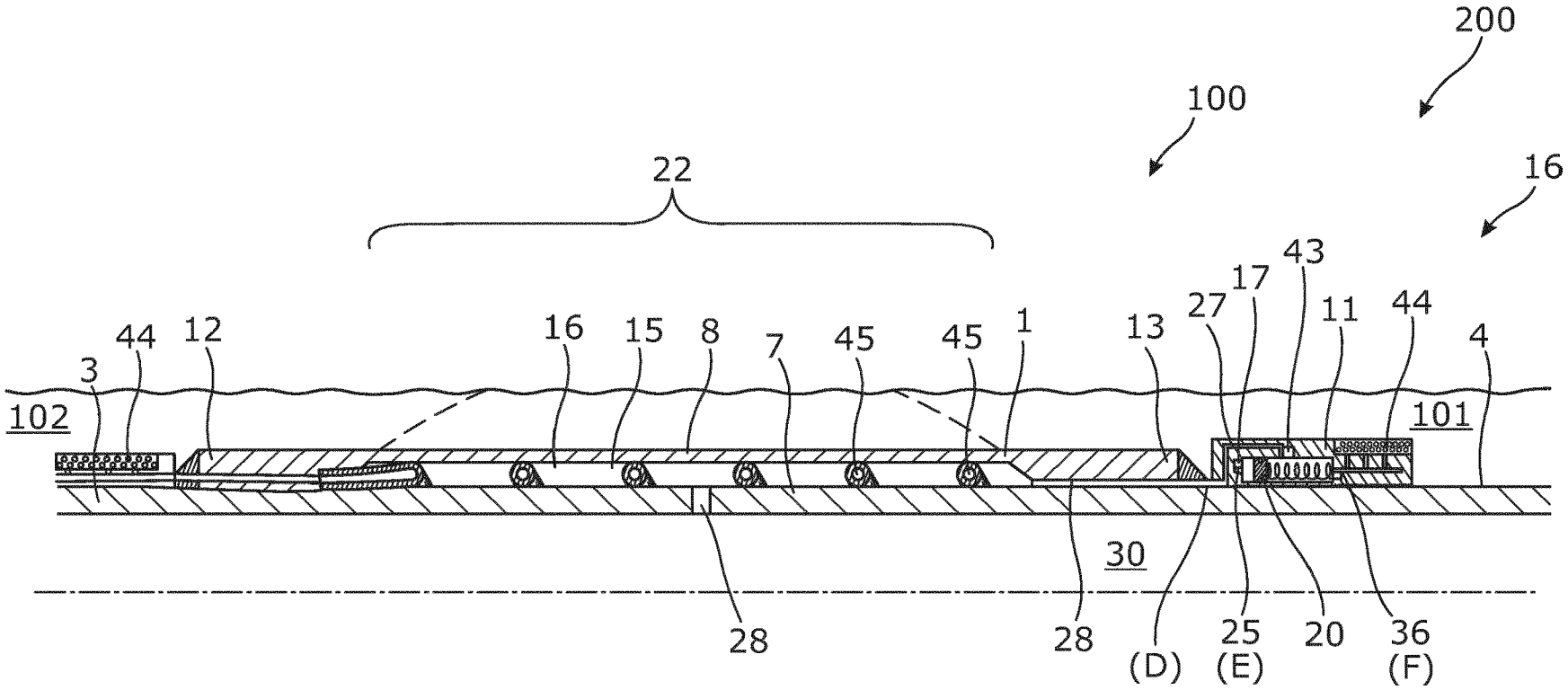
FIG. 10 shows a cross-sectional view of another annular barrier system.

In FIG. 8*a*, the sensor device 16 further comprises a shuttle valve 11 forming an anti-collapsing unit 11 having an element 20 (shown in FIG. 8*b*) shifting back and forth between a first position and a second position depending on the pressure in the first and second zones. The shuttle valve 11 is arranged on an outer face of the tubular metal part 7 or on an outer face of the production casing or the well tubular structure 3, as shown in FIG. 10. The shuttle valve 11, and thus the sensor device 16, is arranged adjacent to the expandable metal sleeve 8, abutting the connection parts of the second end of the expandable metal sleeve 8. In FIG. 3, the sensor device 16 is arranged in abutment with the expandable metal sleeve 8. In FIG. 8*a*, the sensor device 16 is arranged outside the annular space in the connection parts.

The shuttle valve 11 has a first inlet 25 which is in fluid communication with the second zone, and a second inlet 26 which is in fluid communication with the first zone, and the shuttle valve having an outlet which is in fluid communication with the annular space, and in the first position, the first inlet 25 is in fluid communication with the outlet, equalising the second pressure of the second zone with the space pressure, and in the second position, the second inlet 26 is in fluid communication with the outlet, equalising the first pressure of the first zone with the space pressure. The second pressure sensor 36 is arranged in connection with the first inlet 25 of the shuttle valve, and the first pressure sensor 17 is arranged in connection with the second inlet 26 of the shuttle valve. Furthermore, a third pressure sensor is arranged in connection with the outlet 27 measuring the space pressure and is thus capable of measuring the pressure during expansion of the annular barrier.

Figure 8B:
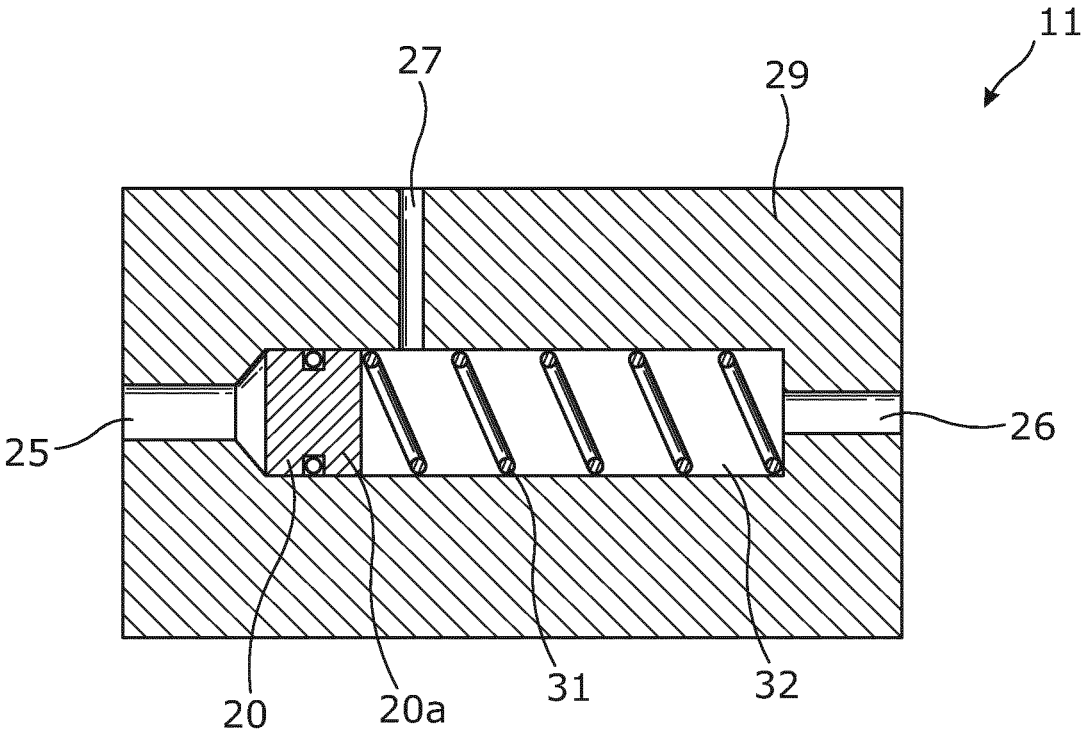
FIG. 8*b* shows a shuttle valve.

In FIG. 8*b*, the first inlet 25 of the anti-collapsing unit 11 is in fluid communication with the second zone through a conduit 45 (shown in FIG. 10) extending through the annular space 15 as shown in FIG. 10. Furthermore, a screen 44, shown in FIGS. 8*a* and 10, is arranged on the outer face of the tubular metal part 7 and upstream of the second inlet 26. The conduit 45 in FIG. 10 is fastened to the first end 12 of the expandable metal sleeve 8 and is in fluid communication with the second zone 102 through a channel in the first end 12 of the expandable metal sleeve 8 and through a screen 44 or filter 44 arranged outside the space 15 adjacent to the expandable metal sleeve 8. The fluid from the second zone 102 flows in through the screen 44, so that only very small particles are allowed to flow with the fluid into the conduit 45 and further into the shuttle valve 11 arranged in the first zone 101. The fluid from the first zone 101 is, in the same way, let in through a screen 44 or filter 44 before entering the shuttle valve 11.

The conduit 45 shown in FIG. 10 is arranged in the space 15 and extends helically around the outer face 4 of the tubular metal part 7. The conduit 45 thus also functions as an anti-collapsing means during insertion of the annular barrier 1 in the borehole. During insertion of the production casing or well tubular structure 3 for production of hydrocarbon-containing fluid, the expandable metal sleeve 8 may hit against projections in the borehole, which could cause the expandable metal sleeve 8 to slightly collapse inwards if the conduit 45 was not present. The conduit 45 may be connected with the first inlet 25 of the shuttle valve 11 and sensor device 16 in another cross-sectional plane than that shown in FIG. 10. The dotted line illustrates the position of the expandable metal sleeve 8 after expansion.

In FIG. 8*b*, the element 20 of the shuttle valve is a piston 20*a* movable in a piston housing 29 between the first position and the second position. The piston housing 29 has a bore 32 in which a spring 31 is arranged. The spring 31 is compressed when the piston 20*a* moves in a first direction towards the second inlet 26, and the second pressure is higher than the space pressure and the first pressure. The piston 20*a* moves until access is provided to the outlet 27, and thus until fluid communication to the space is provided. When the space pressure has been equalised with the second pressure, the spring 31 forces the piston 20*a* back, thereby shutting off the fluid communication between the first inlet 25 and the outlet 27, and allowing fluid communication between the first zone and the space.

Figure 9:
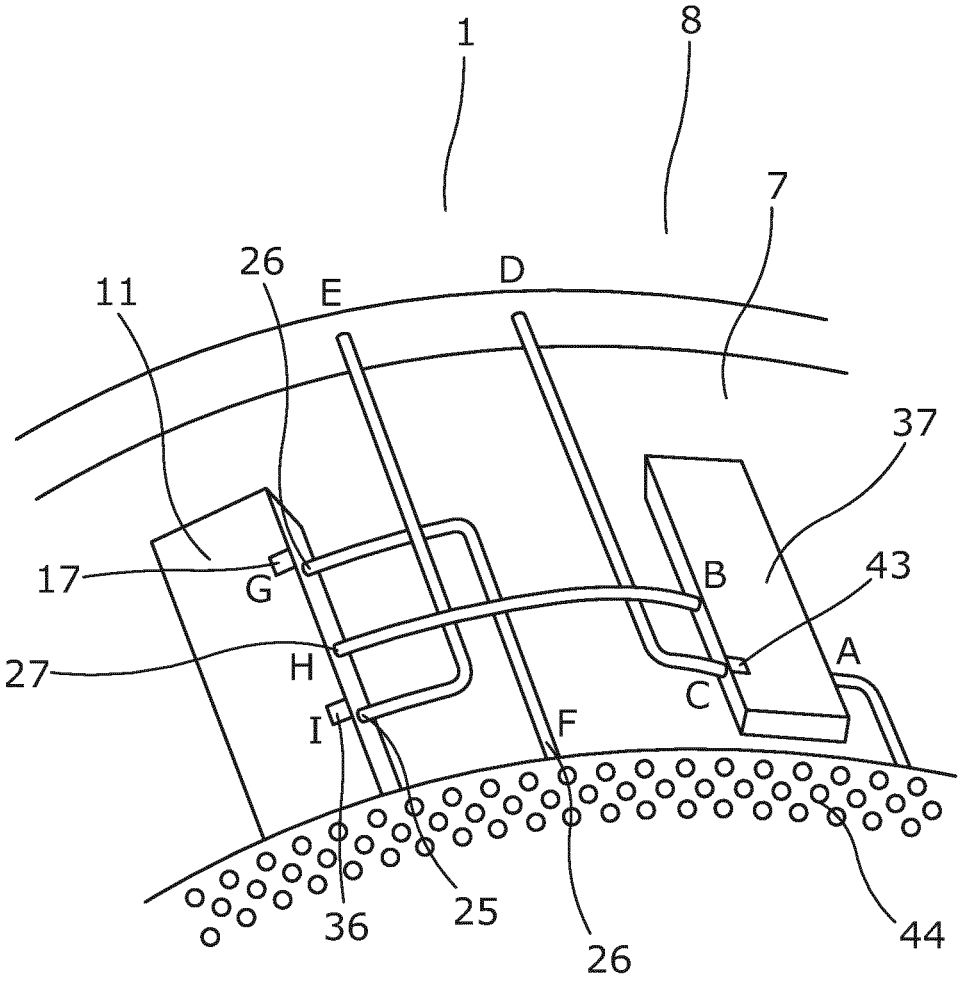
FIG. 9 shows a sensor device comprising a shear pin assembly.

As shown in FIG. 9, the annular barrier 1 further comprises a shear pin assembly 37. The shear pin assembly 37 has a port A receiving fluid from an inside of the well tubular structure through the screen 44. The port A is fluidly connected with a port D during expansion, causing the expansion fluid within the well tubular structure to expand the expandable metal sleeve 8. When the expandable metal sleeve 8 is expanded to abut the wall of the borehole, the pressure builds up and a shear pin or disc within the shear pin assembly shears, closing the fluid connection from port A and opens the fluid connection between a port B and a port C, so that fluid from the second inlet can be let into the space through the shear pin assembly. When the second pressure increases in the second zone, fluid from a port E connected with a port I, being the first inlet 25, presses the element in the shuttle valve to move, so that fluid communication is provided between port I and a port H, being the outlet, and thus further through ports B and C and into the space through port D. When the first pressure increases in the first zone, the element is forced in the opposite direction, and fluid communication between ports G and port H is provided, i.e. fluid communication between the second inlet and the outlet of the shuttle valve or anti-collapsing unit 11, and thus fluid is let into the space through ports B, C and D.

Figure 12:
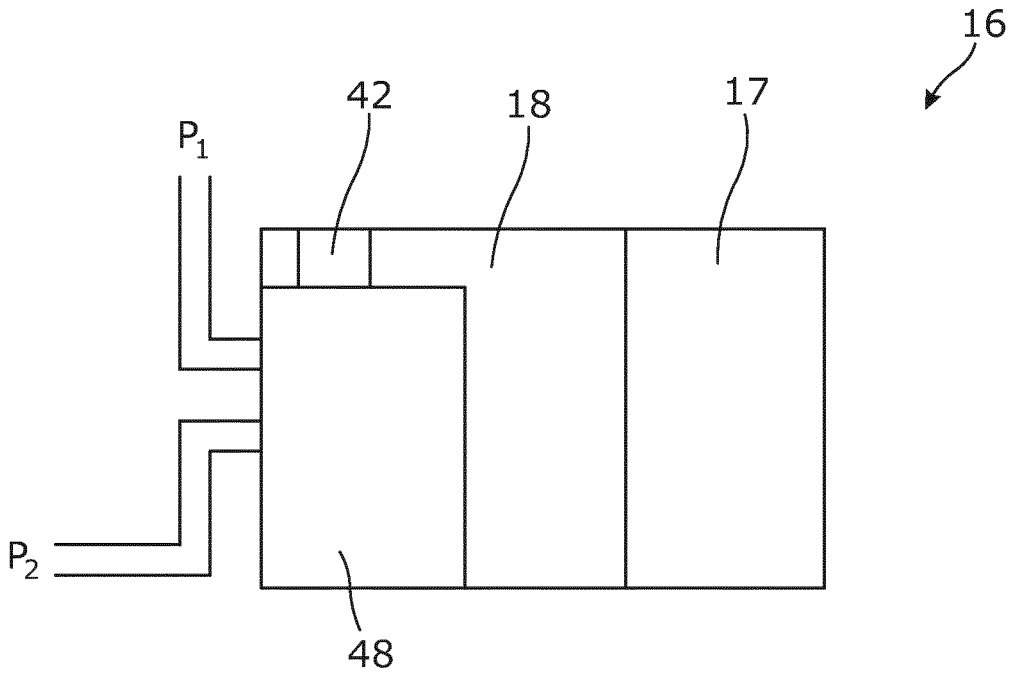
FIG. 12 shows another sensor device.

In FIG. 12, the control unit 18 comprises a three-way valve 48 arranged in connection with the first pressure sensor 17. The three-way valve is controlled by the solenoid 42 to switch between fluid communication between the first pressure sensor 17 and the first or second zone respectively.

The annular barrier 1 may comprise a third pressure sensor 43 in fluid communication with the annular space. In FIG. 8*a*, the third pressure sensor 43 is arranged in connection with the outlet 27 of the valve 11, and in FIG. 7 the third pressure sensor 43 is arranged in the annular space 15 together with a third communication module 24*b* so that data can be transmitted. In FIG. 8*a*, the third pressure sensor is arranged in the first zone but the sensor device 16 and thus the pressure sensors may also be arranged in the second zone.

The annular barrier 1 is primarily made of metal; thus, the expandable metal sleeve is made of metal and the tubular metal part is made of metal. The annular barrier may comprise sealing elements arranged on the outer face of the expandable metal sleeve 8 and in between the tubular metal part and ends of the expandable metal sleeve 8 or connection parts 14, 15*b*.

As shown in FIG. 10, an opening 28 is arranged in the tubular 43 part for letting pressurised fluid into the annular space 15 in order to expand the expandable 43 sleeve 8. Furthermore, even though not shown, the annular barrier may comprise a second sleeve arranged in the annular space 15, and an opening may be provided in the expandable metal sleeve, so that fluid from one of the zones may enter the opening in the sleeve and equalise the pressure in the annular space without the sealing ability of the annular barrier 1 being compromised in that the second sleeve seals off the fluid communication with the well tubular structure.

The pressure sensor response can be used to evaluate the expansion of the annular barrier 1. As the expansion port or opening geometry is known, the pressure and time information during expansion can be used to validate the expansion by estimating the overall volume used for the expansion of the annular barrier and thus the volume of the annular space after expansion.

As shown in FIG. 1*a*, the invention further relates to a downhole completion system 200 comprising a well tubular structure or production casing 3, and two annular barrier systems 100 for isolating a production zone or the second zone 102. The annular barriers 1 are connected with sensor devices 16, so that the sensor device lowest in the well communicates, e.g. wirelessly, with the sensor device 16 further up and closer to the top 47 of the well, which then communicates with communication units 46. The downhole completion system further comprises a pressure source 53 for increasing the second pressure of the second zone from the top of the well. The first pressure in the first zone or the second pressure in the second zone may also be increased via a frac port 54 (shown in FIG. 11), a sliding sleeve, an inflow valve or port or a porter collar.

In FIG. 11, the downhole completion system 200 further comprises a downhole tool 50 having a tool communication module 51 for reading and/or loading measurements from the sensor device 16 of the annular barrier system 100.

The present invention also relates to a verification method for verifying zone isolation between a first zone having a first pressure and a second zone having a second pressure of the borehole. Subsequent to the expansion of an annular barrier system according to the present invention, it should provide zone isolation between the first zone having the first pressure and the second zone having the second pressure. However, verification that the zone isolation functions as intended is essential.

The verification is performed by increasing the first pressure in the first zone. The increase of pressure may for instance be performed by pressurising a fluid from the surface of the well, thereby ensuring that the first pressure exceeds the formation pressure and thereby the second pressure in the second zone. The increase of pressure may also be obtained by other measures. For instance, a hydraulic fracturing pressure increases the pressure in the zone on which it is exerted, whereby this increased pressure may be used to verify the zone isolation between the zone being fractured and the adjacent zone isolated by the annular barrier system according to the invention.

After increasing the first pressure, it is measured and the second pressure is also measured. The two measured pressures are then compared with each other. If the increased first pressure, at the time of comparison, is larger than the second pressure, then zone isolation is intact. However, if the increased first pressure is substantially equal to the second pressure, the intended zone isolation between the first and second zones is most likely lost. Thus, another annular barrier system may be expanded for providing the zone isolation, which again may be verified in the same manner as described above.

The measured first and second pressures on each side of the annular barrier system may be transmitted from the sensor device to a downhole tool and/or a receiver for further processing.

The sensor device comprises a power supply, for instance a battery pack, which may be used over time. Thus, the power supply is preferably of the rechargeable type, so that it may be recharged by for instance a downhole tool having a recharge unit.

Advantageously, after zone isolation has been verified by use of the annular barrier system according to the present invention, the sensor device of the annular barrier system may subsequently be used to monitor the well downhole.

Accordingly, a monitoring method for monitoring a condition of a well is provided by the annular barrier system according to the invention. The monitoring method comprises the steps of:

expanding the annular barrier system for providing zone isolation between a first zone having a first pressure and a second zone having a second pressure, measuring the first pressure, measuring the second pressure, repeating the steps of measuring the first and second pressures, and storing and/or transmitting the measured pressures.

By repeating the measuring of the first and second pressures, the condition of the well at the position of the annular barrier system may be monitored in view of the pressures. For instance, if it is detected that a pressure is changing, it may be an indication that a water content of the well fluid in the present zone is increasing.

The repeated measurements of the pressures may be stored in a storage unit, such as recorder or memory, or it may be transferred wirelessly to for instance a well data module. The well data module may receive measured data from many different positions in the well, whereby the overall condition and status of the well may be monitored, and thus the production of the well may also be optimised in view of the measured data, inter alia the measured pressures.

Furthermore, a third pressure sensor may be arranged in connection with the annular space for measuring a third pressure inside the annular space. The third pressure may be compared with the first pressure and/or the second pressure continuously, whereby the third pressure may be equalised with the first pressure when the first pressure is higher than the third pressure or the third pressure may be equalised with the second pressure when the second pressure is higher than the third pressure. Hereby it is obtained that that zone isolation may be maintained even in circumstances in which the pressure increase in either the first zone or the second zone, and furthermore the risk of the annular barrier collapsing, is minimised considerably.

The pressure sensors or additional sensors measure a fluid property resulting in a response or data which is stored and/or transmitted to be analysed. The response of the sensors may therefore be the measured data.

A stroking tool is a tool providing an increased pressure locally for expanding the expandable metal sleeve or pressurising a zone in order to verify the isolation ability of the annular barrier system 100. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure or production casing is meant any kind of pipe, tubing, tubular, liner, string etc. used permanently installed downhole for producing oil or natural gas. The tubular metal part may be made of metal and may be in the same metal as the well tubular structure.

In the event that the tool is not submergible all the way into the casing, a driving unit 52 such as a downhole tractor, can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system comprising:

a production casing installed in a borehole, and an annular barrier system to be expanded in an annulus between the production casing and a wall of a borehole or another well tubular structure downhole for providing zone isolation between a first zone having a first pressure and a second zone having a second pressure of the borehole, the annular barrier system comprising an annular barrier comprising:

a tubular metal part mounted as part of the production casing, the tubular metal part having an outer face, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, the annular space having a space pressure, wherein the annular barrier system further comprises a sensor device which is in communication with the first zone and the second zone to measure the first pressure of the first zone and the second pressure of the second zone for verifying the zone isolation.

2. The downhole completion system according to claim 1, wherein the sensor device comprises an acoustic transducer.

3. The downhole completion system according to claim 1, wherein the sensor device comprises a piezoelectric element.

4. The downhole completion system according to claim 1, wherein the sensor device comprises at least one pressure sensor for measuring the first and the second pressures.

5. The downhole completion system according to claim 4, wherein the sensor device comprises a control unit for providing communication between the at least one pressure sensor and the first zone or the at least one pressure sensor and the second zone.

6. The downhole completion system according to claim 4, wherein the at least one pressure sensor comprises a first pressure sensor in communication with the first zone and a second pressure sensor in communication with the second zone.

7. The downhole completion system according to claim 6, wherein the first pressure sensor is arranged in the first zone and the second pressure sensor is arranged in the second zone.

8. The downhole completion system according to claim 6, further comprising a third pressure sensor in fluid communication with the annular space.

9. The downhole completion system according to claim 1, wherein the sensor device comprises a storage module.

10. The downhole completion system according to claim 1, wherein the sensor device comprises a communication module.

11. The downhole completion system according to claim 10, wherein the communication module comprises an acoustic transducer.

12. The downhole completion system according to claim 11, wherein the acoustic transducer comprises a piezoelectric element.

13. The downhole completion system according to claim 1, wherein the sensor device comprises a power supply.

14. The downhole completion system according to claim 13, wherein the communication module comprises an induction unit configured to charge the power supply.

15. The downhole completion system according to claim 1, wherein the sensor device comprises an additional sensor adapted to measure at least one fluid property, the fluid property being capacitance, resistivity, flow rate, water content or temperature.

16. The downhole completion system according to claim 15, wherein the additional sensor is a flow rate sensor, a capacitance sensor, a resistivity sensor, an acoustic sensor, a temperature sensor or a strain gauge.

17. A verification method for verifying zone isolation between the first zone and the second zone, the method comprising:

expanding the annular barrier system according to claim 1 for providing the zone isolation between the first zone having the first pressure and the second zone having the second pressure, increasing the first pressure, measuring the first increased pressure and the second pressure, and performing an isolation check by comparing the increased first pressure with the second pressure.

18. A monitoring method for monitoring a condition of a well, comprising:

expanding the annular barrier system according to claim 1 for providing zone isolation between the first zone and the second zone, measuring the first pressure, measuring the second pressure, repeating the steps of measuring the first and second pressures, and storing and/or transmitting the measured pressures.

19. A monitoring method according to claim 18, further comprising:

measuring a third pressure inside the annular space, comparing the third pressure with the first pressure and/or the second pressure, and equalising the third pressure with the first pressure or with the second pressure.

20. The downhole completion system according to claim 1, wherein the sensor device is directly connected to the tubular metal part or a connector of the annual barrier system that connects the tubular metal part to the production casing.

21. The downhole completion system according to claim 20, wherein the sensor device is directly connected to the connector.

22. The downhole completion system according to claim 1, wherein the sensor device is arranged in abutment with the expandable metal sleeve.

23. The downhole completion system according to claim 1, wherein the sensor device is directly connected to or integrated with the annular barrier system.

24. The downhole completion system according to claim 23, wherein the sensor device is directly connected to or integrated with the expandable metal sleeve.

25. A downhole completion system comprising:

a production casing installed in a borehole, and an annular barrier system to be expanded in an annulus between the production casing and a wall of a borehole or another well tubular structure downhole for providing zone isolation between a first zone having a first pressure and a second zone having a second pressure of the borehole, the annular barrier system comprising an annular barrier comprising:

a tubular metal part mounted as part of the production casing, the tubular metal part having an outer face, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, the annular space having a space pressure, wherein the annular barrier system further comprises a sensor device having a first pressure sensor which is in communication with the first zone and adapted to measure the first pressure of the first zone and a second pressure sensor which is in communication with the second zone and adapted to measure the second pressure of the second zone for verifying the zone isolation.

* * * * *